US008434898B2

(12) United States Patent
Sanfilippo et al.

(10) Patent No.: US 8,434,898 B2
(45) Date of Patent: May 7, 2013

(54) MODULAR LIGHTING ARRAYS

(75) Inventors: James Sanfilippo, Altadena, CA (US); Alan McFarland, Van Nuys, CA (US)

(73) Assignee: Nila Inc., Altadena, CA (US)

( * ) Notice: Subject to any disclaimer, the term of this patent is extended or adjusted under 35 U.S.C. 154(b) by 0 days.

(21) Appl. No.: 13/299,704

(22) Filed: Nov. 18, 2011

(65) Prior Publication Data

US 2012/0062152 A1 Mar. 15, 2012

Related U.S. Application Data

(62) Division of application No. 12/142,720, filed on Jun. 19, 2008, now Pat. No. 8,066, 403.

(60) Provisional application No. 60/945,506, filed on Jun. 21, 2007.

(51) Int. Cl.
*F21V 21/00* (2006.01)

(52) U.S. Cl.
USPC ..... 362/249.02; 362/249.03; 362/318; 362/319; 362/326; 362/294

(58) Field of Classification Search ..... 362/249.02, 362/240, 318, 319, 326, 294; 315/312
See application file for complete search history.

(56) References Cited

U.S. PATENT DOCUMENTS 5,267,070 A 11/1993 Stewart et al.
5,600,910 A 2/1997 Blackburn
5,640,069 A 6/1997 Nilssen
5,660,461 A 8/1997 Ignatius et al.
5,779,351 A 7/1998 Erickson et al.
6,340,868 B1 1/2002 Lys et al.
6,422,716 B2 7/2002 Henrici et al.
7,180,252 B2 * 2/2007 Lys et al. ..... 315/312
7,355,562 B2 4/2008 Schubert et al.
7,766,505 B2 8/2010 Tseng et al.
2006/0002110 A1 * 1/2006 Dowling et al. ..... 362/252
2006/0097270 A1 * 5/2006 Yuri ..... 257/88
2007/0091596 A1 4/2007 Grossman et al.

OTHER PUBLICATIONS

Nila, Inc., International Search Report and Written Opinion mailed Sep. 30, 2008, PCT Appln. No. PCT/US2008/067545, 7 pages.

Stojanovic, Milica, "Underwater Wireless Communications: Current Achievements and Research Challenges", OES newsletter, IEEE website; available at http://www.ieee.org/organizations/pubs/newsletters/oes/html/spring06/underwater.html.

* cited by examiner

*Primary Examiner* — Ali Alavi

(74) *Attorney, Agent, or Firm* — Blakely, Sokoloff, Taylor & Zafman LLP

(57) ABSTRACT

Apparatus, systems, architectures, and methods provide interlocked modular lighting array units to operate as a single large light source. The modular lighting array units may be connected by a network, and the modular lighting array units may communicate and send and receive control or status signals. In some embodiments, the signals may correspond to status of light sources or LEDs, lighting functions, effects routines, and various other signals of communication.

14 Claims, 11 Drawing Sheets

Hardware Block Diagram

MODULAR LIGHTING ARRAYS

CROSS-REFERENCE

This application is a divisional of U.S. application Ser. No. 12/142,720 filed Jun. 19, 2008, which application claims the benefit of U.S. Provisional Application No. 60/945,506 filed Jun. 21, 2007, which applications are incorporated herein by reference in their entireties.

BACKGROUND OF INVENTION

Lighting needs depend on the application for which the lighting is being applied. Reduction in complexity of lighting design and time associated in the design and its implementation may enhance the over-all lighting environment and may result in increased savings in cost, power utilizations, and space for a lighting application.

SUMMARY OF INVENTION

The invention provides systems and methods for modular lighting array units, banks and clusters. Various aspects of the invention described herein may be applied to any of the particular applications set forth below or for any other types of computer power control or broadcast systems or methods. The invention may be applied as a standalone system or method, or as part of an integrated arrangement related to modular lighting. It shall be understood that different aspects of the invention can be appreciated individually, collectively, or in combination with each other.

One aspect of the invention may include a system for networking modular lighting array units with a plurality of modular lighting array units that are interconnected. The system may also include a network to communicatively couple the modular lighting array units, and also a master lighting array unit for controlling the lighting functions of the master unit and other slave modular lighting array units to which it is connected. In some embodiments of the invention, the master unit may control the on-off control, dimming, timing, intensity, or status of itself or other slave modular lighting array units on the network. Further, in some embodiments of the invention, the slave modular lighting array units may communicate responses over the network, to, for example confirm receipt of control signals.

The network over which the modular lighting array units are connected may vary. In some embodiments, the network may be a local area network, a wireless network, or a power line network. Further, the network communications may operate over stranded wire pairs, a cable medium, an optical fiber, a power line, infrared, laser-linking, electromagnetic induction coupling, sonic communications, ultrasonic communications, or RF communications.

Another aspect of the invention provides a method for controlling a plurality of modular lighting array units connected on a network. A master unit may be selected to control lighting functions of the master unit and the other modular lighting array units. The master unit or an external control box may send a control signal corresponding to a lighting function to an individual modular lighting array unit or to several modular lighting array units on the network. In response, the modular lighting array units receiving the signal may implement the lighting function.

In some embodiments of the invention the master unit may be able to control the on-off functions, dimming, or timing of other modular lighting array units over the network. Further, the modular lighting array unit receiving the control signal may send a verification code to the master unit or control box, for example, to confirm receipt of the control signal. In addition, the network could communicate using stranded wire pairs, a cable medium, an optical fiber, a power line, infrared, laser-linking, electromagnetic induction coupling, sonic communications, ultrasonic communications, or RF communications.

Another aspect of the invention provides for a lighting apparatus in which a plurality of modular lighting array units are interconnected. Each lighting array unit has an array of light sources, a power supply, is mounted to a cooling device, and is connected to other modular lighting array units. The units may be connected by mating portions that include male and female sides, which may further be in a diamond-like shape, a spherical shape, or a tongue and groove shape. The units may also be connected by complementary mating portions having mirroring shapes. Alternatively, the units may be connected by a bolting mechanism, a friction device or by some other means.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

INCORPORATION BY REFERENCE

All publications and patent applications mentioned in this application are herein incorporated by reference to the same extent as if each individual publication or patent application was specifically and individually indicated to be incorporated by reference.

BRIEF DESCRIPTION OF THE DRAWINGS

Embodiments of the invention are illustrated by way of example and not limitation in the figures of the accompanying drawings in which.

DETAILED DESCRIPTION OF INVENTION

The following description refers to the accompanying drawings that show, by way of illustration, details and embodiments in which the invention may be practiced. These embodiments are described in sufficient detail to enable those skilled in the art to practice embodiments of the present invention. Other embodiments may be utilized and structural, logical, and electrical changes may be made without departing from the inventive subject matter. The various embodiments disclosed herein are not necessarily mutually exclusive, as some embodiments can be combined with one or more other embodiments to form new embodiments. The following detailed description is, therefore, not to be taken in a limiting sense.

Figure 1B:
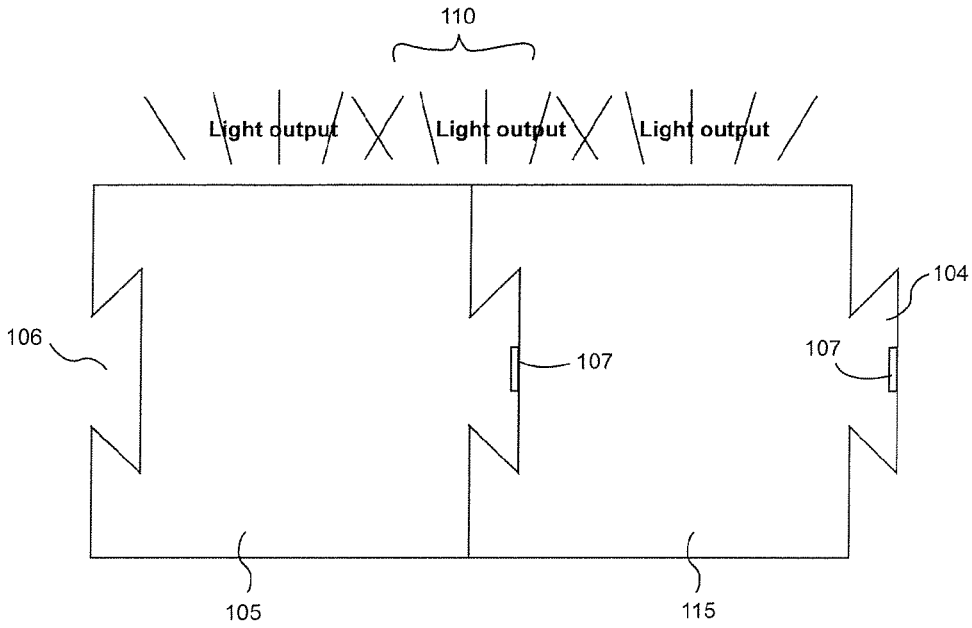
FIG. 1A-B depict an embodiment of an apparatus having multiple modular lighting array units configurable to join together to form a larger lighting array unit (bank or cluster).
Figure 1A:
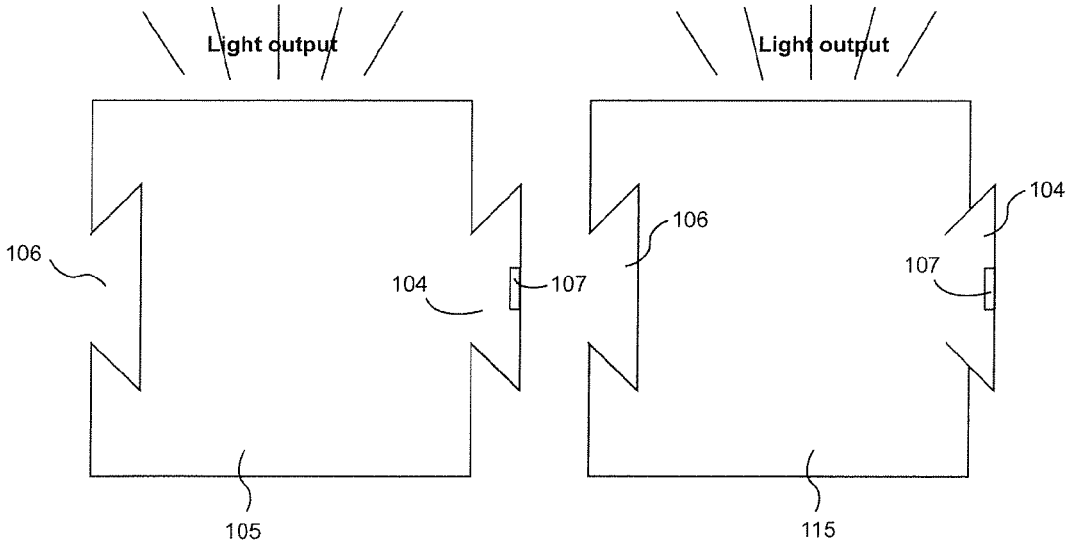

FIGS. 1A-B depict an embodiment of an apparatus having modular lighting array units 105, 115 configurable to join together to form a larger lighting array unit (bank or cluster) 110. FIG. 1A shows both modular lighting array unit 105 and modular lighting array unit 115 having at least two mating portions, one to enter into another modular lighting array unit and one to receive a mating portion from another modular lighting array unit. Mating portion 104 of modular lighting array units 105, 115 is structured to interlock with a receiving portion 106 of modular lighting array units 115, 105. Mating portion 104 may be structured as an extension of modular lighting unit 105 having a shape and dimensions to conform to mating portion 106 of modular lighting unit 115 in which mating portion 106 is structured as a recessed area. Mating portion 104 is commonly referred to as a male side or male connection and mating portion 106 is commonly referred to as a female side or female connection.

FIG. 1B shows modular lighting array units 105 and 115 coupled together by the insertion of mating portion 104 of modular lighting array unit 105 into the mating portion 106 of modular lighting array unit 115, interlocked such that effectively a single lighting area is formed. The dove-tails 104, 106 may be secured with a friction device, such as a friction nut 107 in the male side 104 of modular lighting unit 105 that slides into the female side 106 of modular lighting unit 115. An example of a friction nut includes, but is not limited to, a set screw. Another type of friction device may be a friction clamp. The shape of mating portion 104 and mating portion 106 may be realized in a number of different manners. In the embodiment shown in FIGS. 1A-1B the mating portions have a diamond-like shape. Though FIGS. 1A and 1B depict two modular units combined with the diamond-like interlocking mechanism, as can be seen with coupling portion 104 and coupling portion 106 unattached, additional modular units can be added to the right of modular lighting array units 115 and/or to the left of modular lighting array unit 105. Additional mating portions 104, 106 may be structured on two other sides of modular lighting array units 105, 115 to provide a single lighting structure of modular lighting array units stacked on modular lighting array units 105, 115. The friction device may also be made of two interlocking or connecting parts of complementary mating portions. For example, the mating portions may not necessarily be a male and female mating portion, but may instead be complementary mating portions which are mirror images of each other, or positive and negative connecting portions. The friction device may also be a tongue and groove device.

Figure 2B:
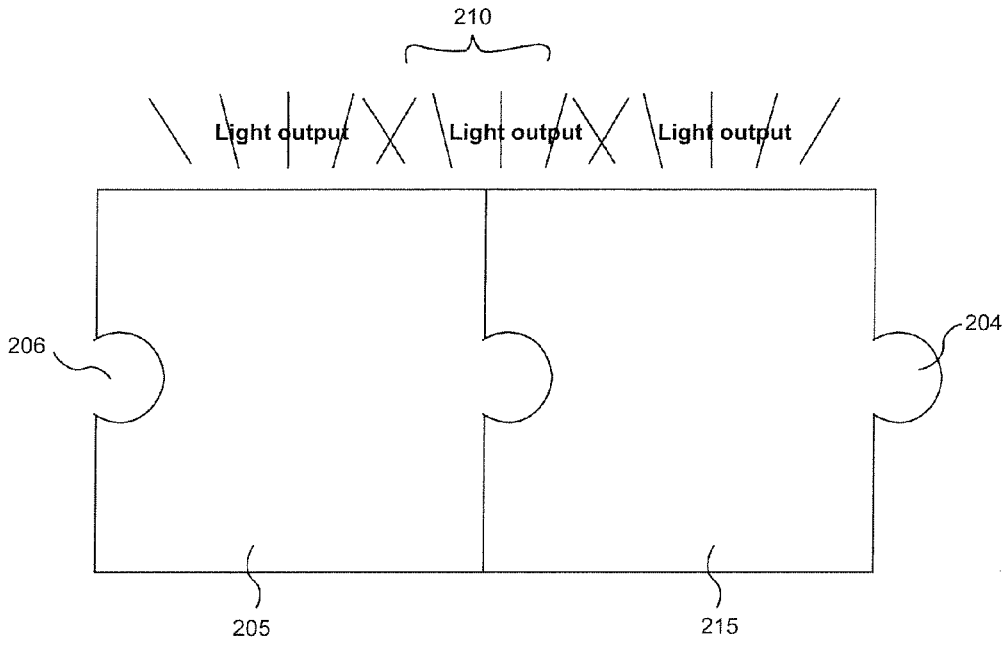
FIGS. 2A-B depict an embodiment of an apparatus having multiple modular lighting array units configurable to join together to form a larger lighting array unit (bank or cluster).
Figure 2A:
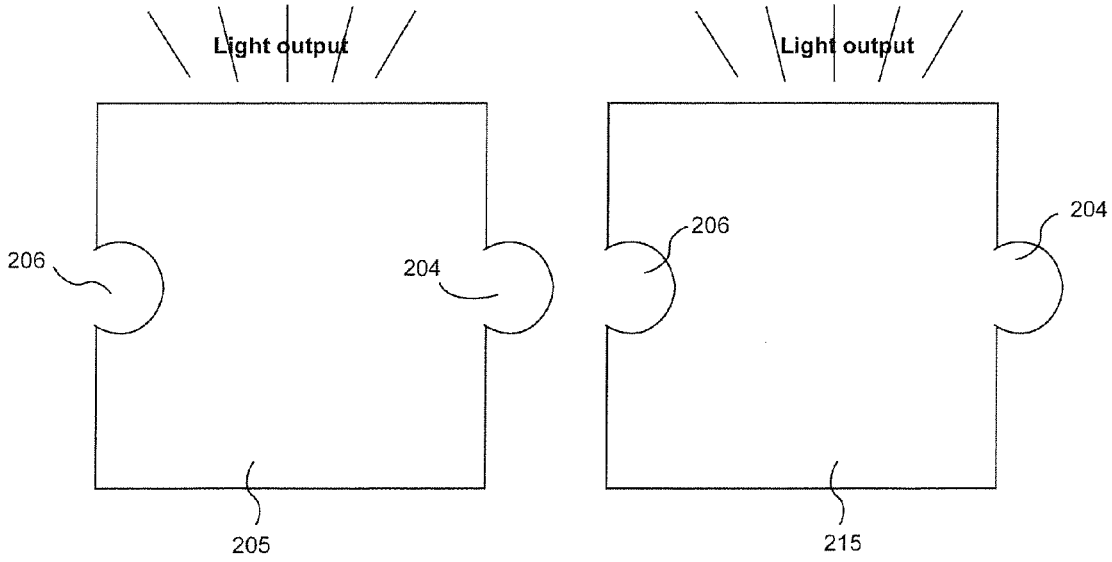

FIGS. 2A-B depict an embodiment of an apparatus having modular lighting array units 205, 215 configurable to join together to form a larger lighting array unit (bank or cluster) 210. FIGS. 2A-B show a similar interlocking of modular lighting array units 205, 215 as in FIGS. 1A-1B, but modular lighting array units 205, 215 have a different shape for dove-tails 204 and 206. The shape of mating portions 204, 206 may be spherical-like (shown as circular-like in the two-dimensional FIGS. 2A-2B) or may have a tongue and groove connection. FIG. 2A shows that both modular lighting array unit 205 and modular lighting array unit 215 have at least two mating portions, one to enter into another modular lighting array unit and one to receive a mating portion from another modular lighting array unit. Mating portion 204 of modular lighting array units 205, 215 may be structured to interlock with a receiving portion 206 of modular lighting array units 215, 205. Mating portion 204, male connection 204, may be structured as an extension of modular lighting unit 205 having a spherical-like shape and dimensions to conform to mating portion 206, female connection 206, of modular lighting unit 215 in which mating portion 206 is structured as a spherical-like recessed area. The dove-tails 204, 206 may be secured with a friction device, such as a friction nut in the male side of modular lighting unit 205 that slides into the female side of modular lighting unit 215. The friction device may also vary, as previously discussed.

FIG. 2B shows modular lighting array units 205 and 215 coupled together by the insertion of mating portion 204 of modular lighting array unit 205 into the mating portion 206 of modular lighting array unit 215, interlocked such that effectively a single lighting area is formed. Though FIGS. 2A and 2B depict two modular units combined with the spherical-like interlocking mechanism, as can be seen with coupling portion 204 and coupling portion 206 unattached, additional modular units can be added to the right of modular lighting array unit 215 and/or to the left of modular lighting array unit 205. Additional mating portions 204, 206 may be structured on two other sides of modular lighting array units 205, 215 to provide a bank or cluster of modular lighting array units stacked on modular lighting array units 205, 215.

Figure 3B:
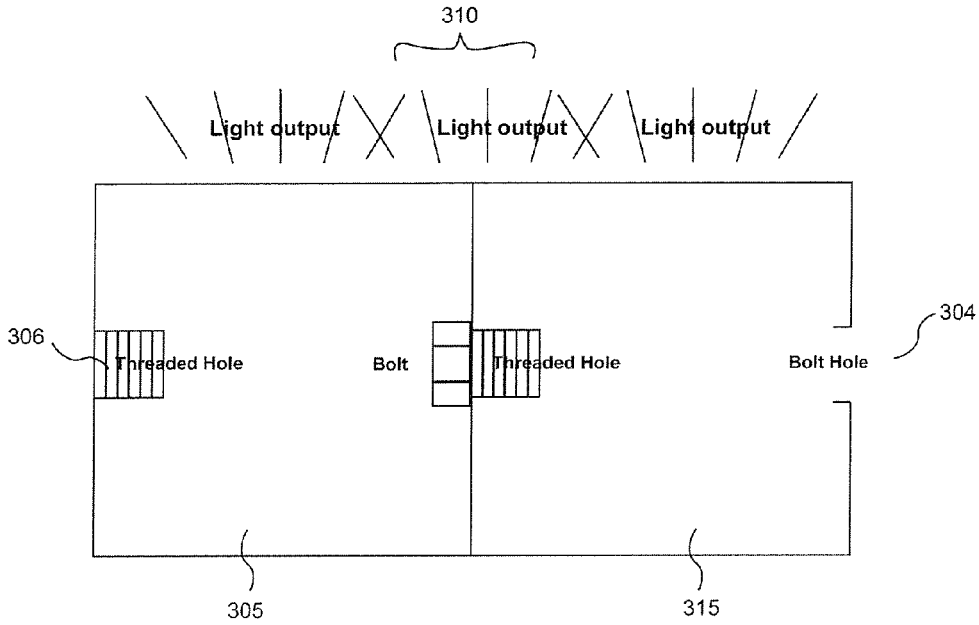
FIG. 3A-B depict an embodiment of an apparatus having multiple modular lighting array units configurable to join together to form a larger lighting array unit (bank or cluster).
Figure 3A:
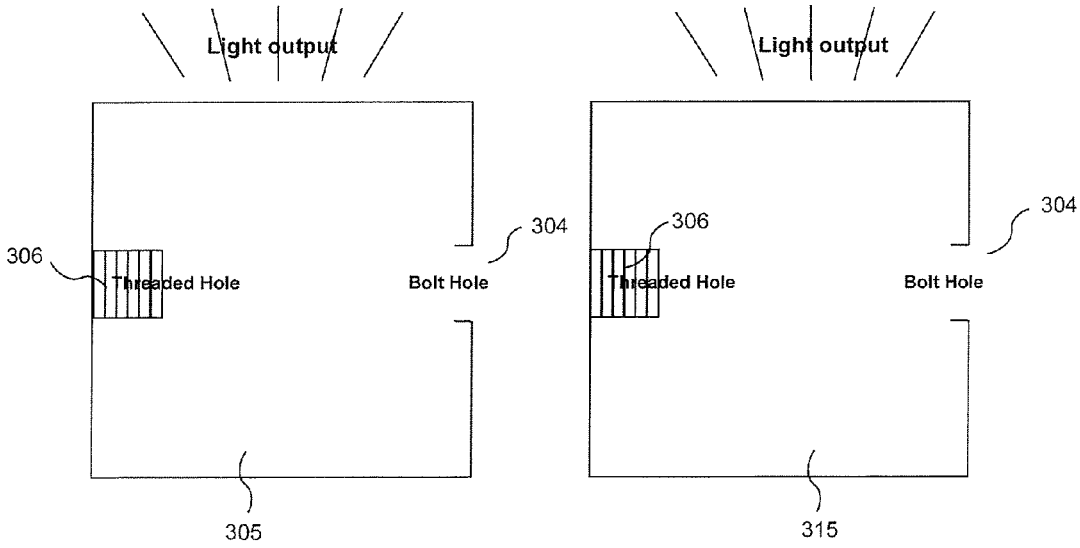

FIGS. 3A-B depict an embodiment of an apparatus having modular lighting array units 305, 315 configurable to join together to form a larger lighting array unit (bank or cluster) 310. FIGS. 3A-B show an interlocking of modular lighting array units 305, 315 that uses a bolting mechanism to join modular lighting array units 305 and 315, rather than mating portions having a common shape and size as in FIGS. 1A-1B and FIGS. 2A-2B. FIG. 3A shows that both modular lighting array unit 305 and modular lighting array unit 315 have at least one hole 304, 306 aligned along a common center line. Hole 304 of modular lighting array unit 305 is a bolt hole that allows a bolt to connect threaded hole 306 of modular lighting array unit 315 to join together modular lighting array unit 305 and modular lighting array unit 315 to form larger modular array (bank or cluster) 310. The bolt used to join the modular lighting array units 305 and 315 is threaded to match the threaded holes of lighting array units 305 and 315.

FIG. 3B shows modular lighting array units 305 and 315 coupled together by a bolt such that effectively a single lighting area is formed. Though FIGS. 3A and 3B depict two modular units combined by a bolting mechanism, as can be seen with coupling portion 304 and coupling portion 306 of modular array (bank or cluster) 310 unattached, additional modular units can be added to the right of modular lighting array unit 315 and/or to the left of modular lighting array unit 305 to increase the size of modular array (bank or cluster) 310. Additional mating portions 304, 306 may be structured on two other sides of modular lighting array units 305, 315 to provide a single lighting structure (bank or cluster) of modular lighting array units stacked on modular lighting array units 305, 315. In an embodiment, the threaded hole of each modular lighting array unit has the same threading arrangement.

Figure 4:
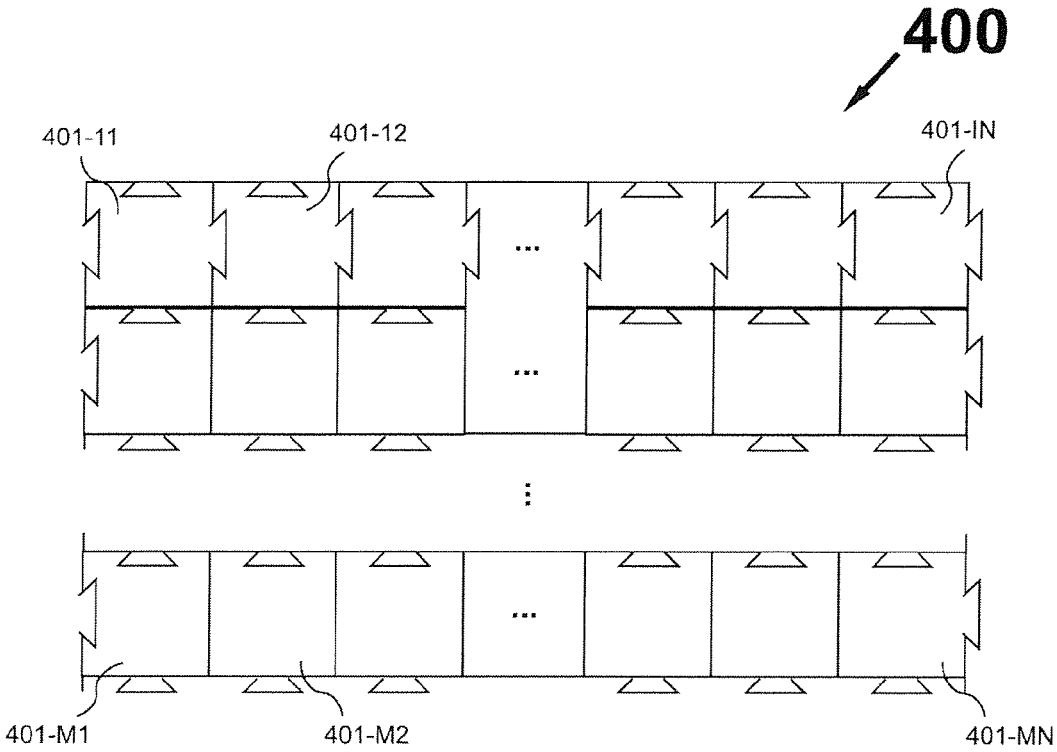
FIG. 4 illustrates an embodiment of an arrangement of modular lighting array units connected along rows and stacked.

FIG. 4 illustrates an embodiment of an arrangement 400 of modular lighting array units connected along rows and stacked, forming a bank or cluster of connected lighting array units. In such an arrangement, the light output is out or into the plane of two-dimensions shown. Each row may have N modular lighting units and there may be m rows. FIG. 4 depicts modular lighting units 401-11, 401-12 . . . 401-1N in the first row and modular lighting units 401-M1, 401-M2 . . . 401-MN in the $M^{th}$ row. In FIG. 4, the modular lighting units are interlocked using a diamond-like mating. Other interlocking mechanisms, such as, but not limited to, a spherical-like mating or a bolting mechanism may be used. In an embodiment, one type of mating may be used in one direction (for example, horizontally) and another type of interlocking mechanism may be used in another direction (for example, vertically). Each modular lighting array unit may be configured as an independent unit. It should be understood that a bank or cluster of modular lighting array units can be formed, including with different numbers of rows and columns, and in other arrangements other than what is shown or described herein.

Figure 5:
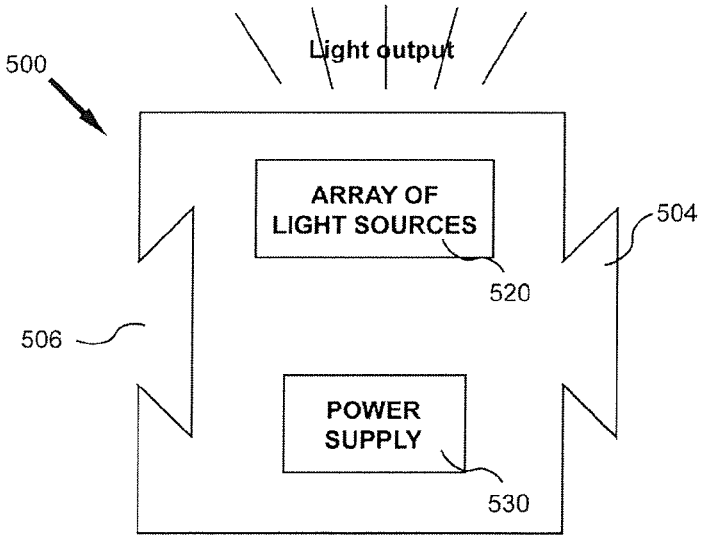
FIG. 5 depicts a block diagram of an embodiment of an individual modular lighting array unit.

FIG. 5 depicts a block diagram of an embodiment of an individual modular lighting array unit 500. Modular lighting array unit 500 may include an array of light source (ALS) 520, a power supply 530, mating connections 504 and 506. Though mating connections 504 and 506 are shown as diamond-like connections, other connection configurations may be used according to embodiments of the teachings discussed herein. Power supply 530 may be a direct current (DC) power supply. Power supply 530 configured as a DC power supply, such as a battery, may be totally self contained in individual modular lighting array unit 500. Power supply 530 may be a unit that receives power from an external source and distributes, regulates, and/or manages the power to other devices within modular lighting array unit 500. Power supply 530 may include MOSFET 800V (TO 247) (STMicroelectronics #STW11NM80). The external power may be a common alternating current (AC) source at a rated voltage. In one embodiment, the power supply 530 may be capable of running the modular lighting array unit 500 with any input voltage between 12V and 480V, AC or DC, such that there are no restrictions on frequency of the AC input.

ALS 520 may be an array of light emitting diodes (LEDs). ALS 520 may include a number of light sources. In an embodiment, ALS 520 includes 24 LEDs. The LEDs may include LED Header Micro-Fitt 3.0 (Molex #538-43650-0212), Temp Header SH 3POS Side 1 mm Tin (JST #455-1803-1-ND), XRCree-LED (Cree #XR7090WT-L1-0001), Temp sensor/Ic thermometer (TO-92L) (Dallas Semiconductor #DS1821), LED PCB (Heatron #LED6JN3), silicon (Burman Industries #TC-5030-5399), and other materials. In an embodiment, ALS 520 may include one light source. However, the various embodiments discussed herein are not limited to a specific number of light sources in ALS 520. In an embodiment, ALS 520 is configured with spacing such that light output from modular lighting unit 500 appears to be from a single source. In one embodiment, individual modular lighting array unit 500 may be joined with one or more individual modular lighting units 500 in a manner similar to that depicted in any of FIGS. 1-4. With ALS 520 in each individual modular lighting unit 500 having a common configuration, the light output from a linearly coupled and/or a stacked configuration of individual modular lighting units 500 appears as light output from a single source.

Figure 6:
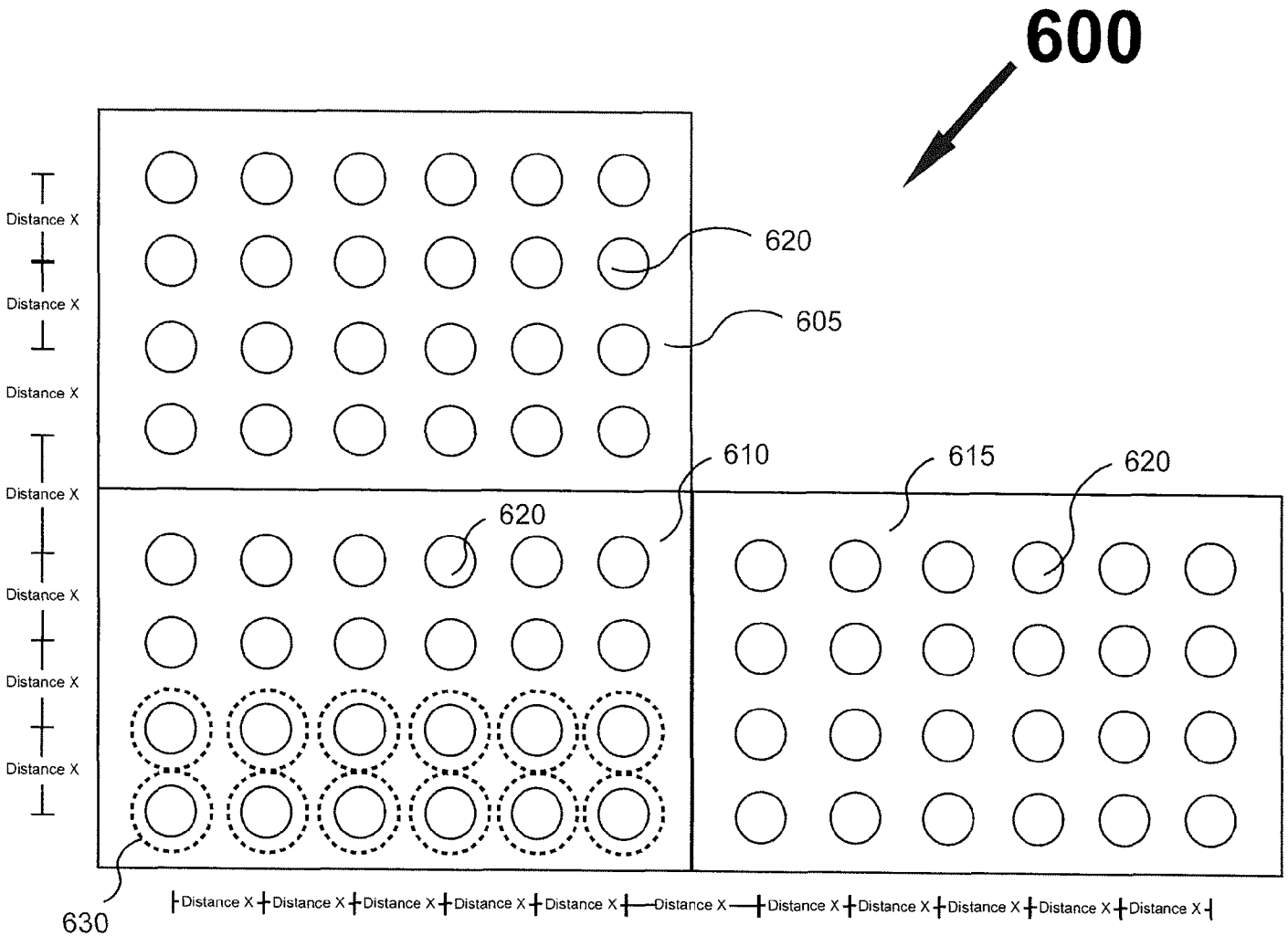
FIG. 6 illustrates an embodiment of modular lighting array units coupled together to operate as a single light apparatus in which each individual light source is equally spaced apart from other individual light sources in the vertical and horizontal directions.

FIG. 6 illustrates an embodiment of a bank or cluster 600 of modular lighting array units 605, 610, and 615 coupled together to operate as a single light source 600 in which each individual light source 620 is equally spaced apart from other individual light sources in the vertical and horizontal directions. The modular lighting array units may also be coupled together to operate as multiple lighting sources. The spacing in the vertical and horizontal directions is represented in FIG. 6 as distance X, where distance X is selected based on the application. Alternatively, the relative spacing between individual light sources 620 may be varied dependent on the application and is not necessary equally spaced. Further, in an embodiment of the invention, the ALS may accept a variety of secondary optics (lens arrays) 630 to provide different beam patterns useful to lighting designers.

Figure 12:
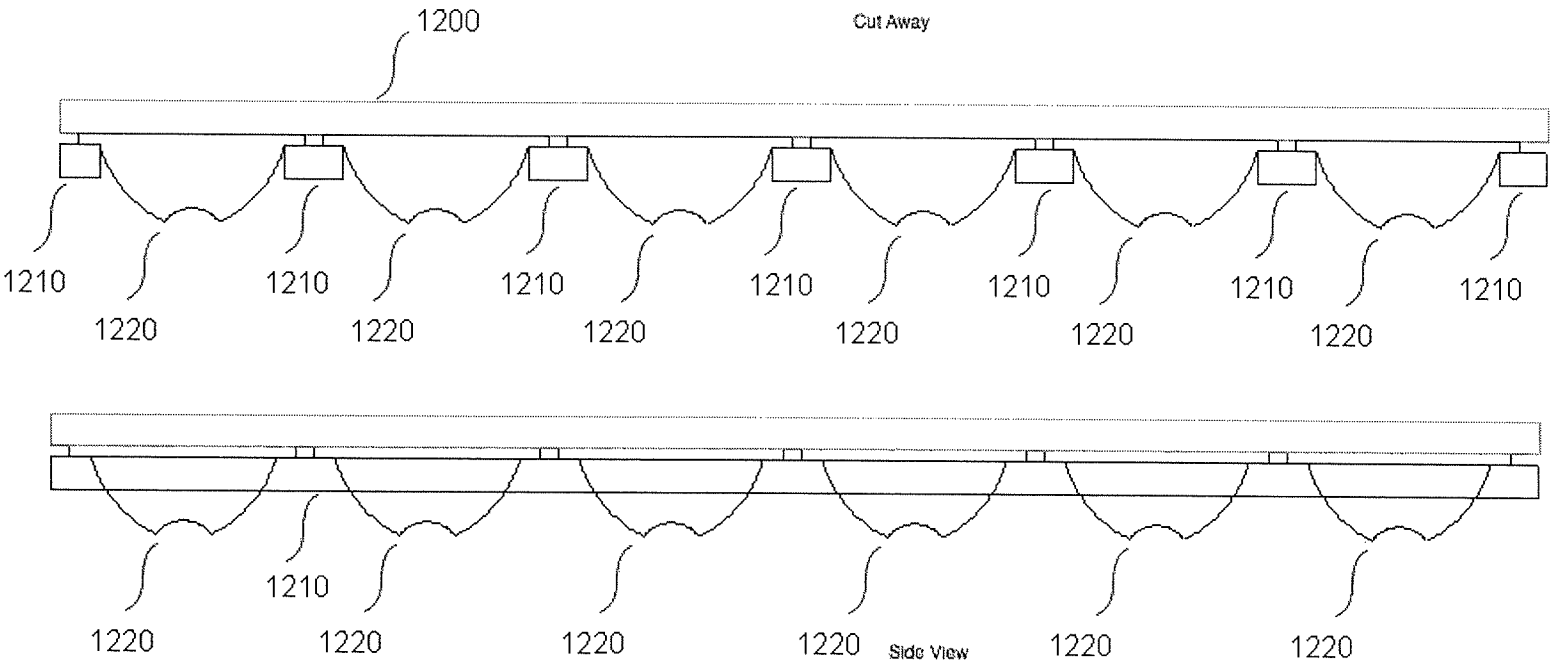
FIG. 12 illustrates a side view and cut away view of two plates and lenses to form an interchangeable lens system to allow for changes in the spread of the light beam.

Referring to FIG. 12, the different beam patterns may be accomplished by interchangeable lens system with lenses 1220 which may be replaced. In FIG. 12, a top plate 1200 and a back plate 1210 hold interchangeable or removable lenses 1220, which may be changed or replaced such that the beam patterns produced can be controlled. In an embodiment, the lenses may be mounted in a bracket comprised of the top plate 1200 and the back plate 1210 which may allow them to be a single or unitary unit. When changed, the entire array of interchangeable lenses 1220 may be replaced such that different beam patterns can be produced. For example, the beam angle of the light source or the character of the light may be changed, to act as a large single light source to avoid shadows.

In one embodiment of the invention, the bank or clusters 600 of modular lighting array units may be controlled to produce certain special effects lighting. For example, it may be possible to have "effects routines" that simulate candle light, fire, lightning strikes, the glow of a TV set, a dying neon sign, etc. The lighting functions may also be controlled to produce lights that act as a flash or a strobe. The "effects routines" may then be lighting functions which products strobing or flashing light. These "effects routines" could be software that could either run in an external control box 820, as later described. Alternatively, the "effects routines" may be software that is built into the electronics 915 of each modular lighting array unit 900, as later described.

Figure 7:
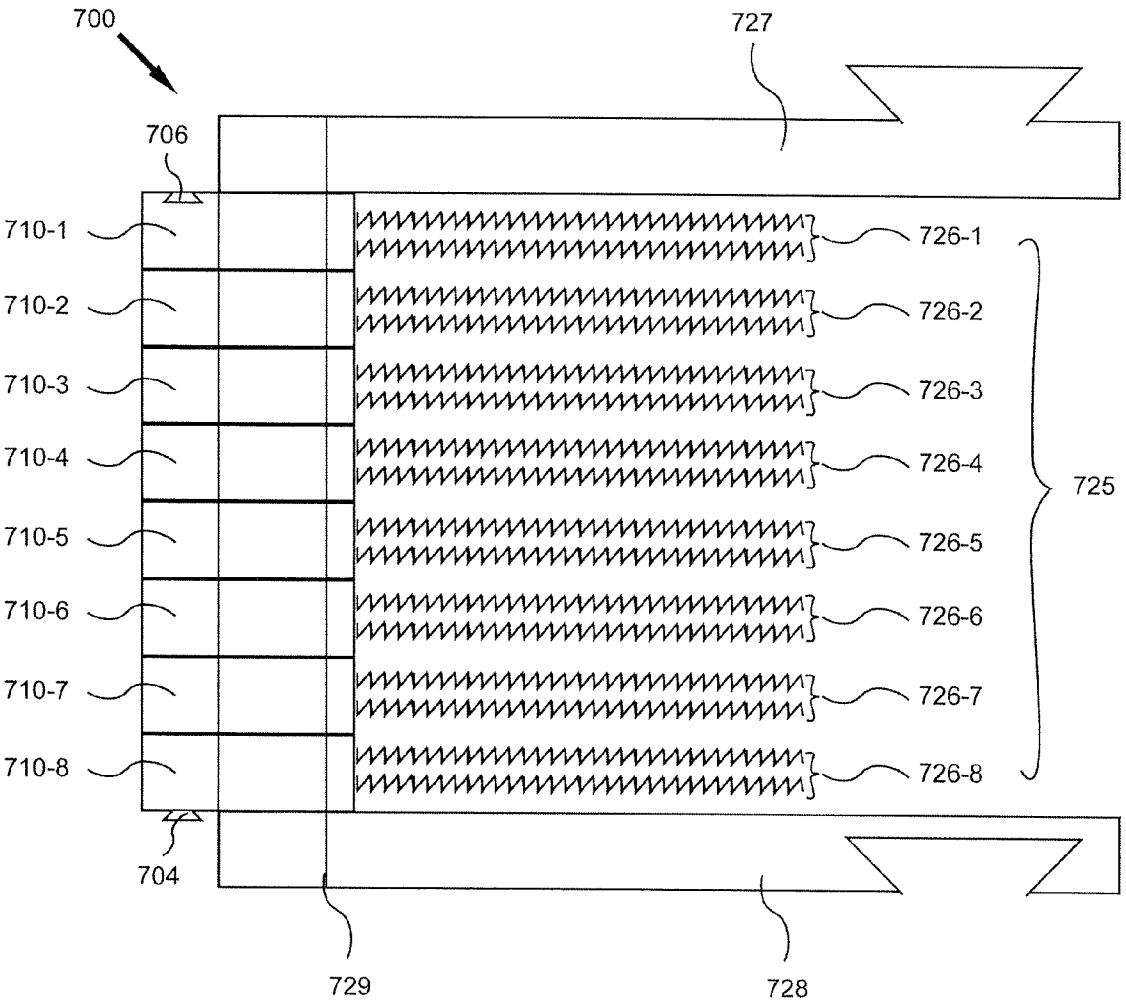
FIG. 7 depicts an embodiment of an apparatus having modular lighting array units interlocked and mounted to a cooling device or heat sink.

FIG. 7 depicts an embodiment of an apparatus 700 having modular lighting array units 710-1 . . . 710-8 interlocked and mounted to a heat sink 725. Modular lighting array units 710-1 . . . 710-8 may be interlocked by diamond-like mating portions 704, 706. Other interlocking mechanisms may be used such as, but not limited to, spherical-like mating portions, bolting mechanism, or combinations of interlocking mechanisms. Heat sink 725 may be structured with a number of heat sink fins with structure supports 727 and 728. In an embodiment, the number of heat sink fins may be equal the number of modular lighting array units. In an example, FIG. 7 shows heat sink 725 having heat sink fins 726-1 . . . 726-8 for modular lighting array units 710-1 . . . 710-8. In an embodiment, the number of heat sink fins may be less than the number of modular lighting array units. In an embodiment, the number of heat sink fins may be greater than the number of modular lighting array units. Heat sink 725 may be constructed as a single unit. Heat sink 725 may be constructed as heat sinks 726-1 . . . 726-8 connected together. In an embodiment, heat sink 725 may be constructed as heat sinks 726-1 . . . 726-8 connected together by a center bolt along 729. It can be appreciated that the scope of the invention will not be limited to any particular construction of a heat sink, but will include any cooling device which transfers the heat generated by the LEDs. Thus, in some embodiments of the invention, a solid state fan with no moving parts, which cools using air flow which moves due to magnetic forces, may operate as a heat sink within the scope of the invention.

Figure 8:
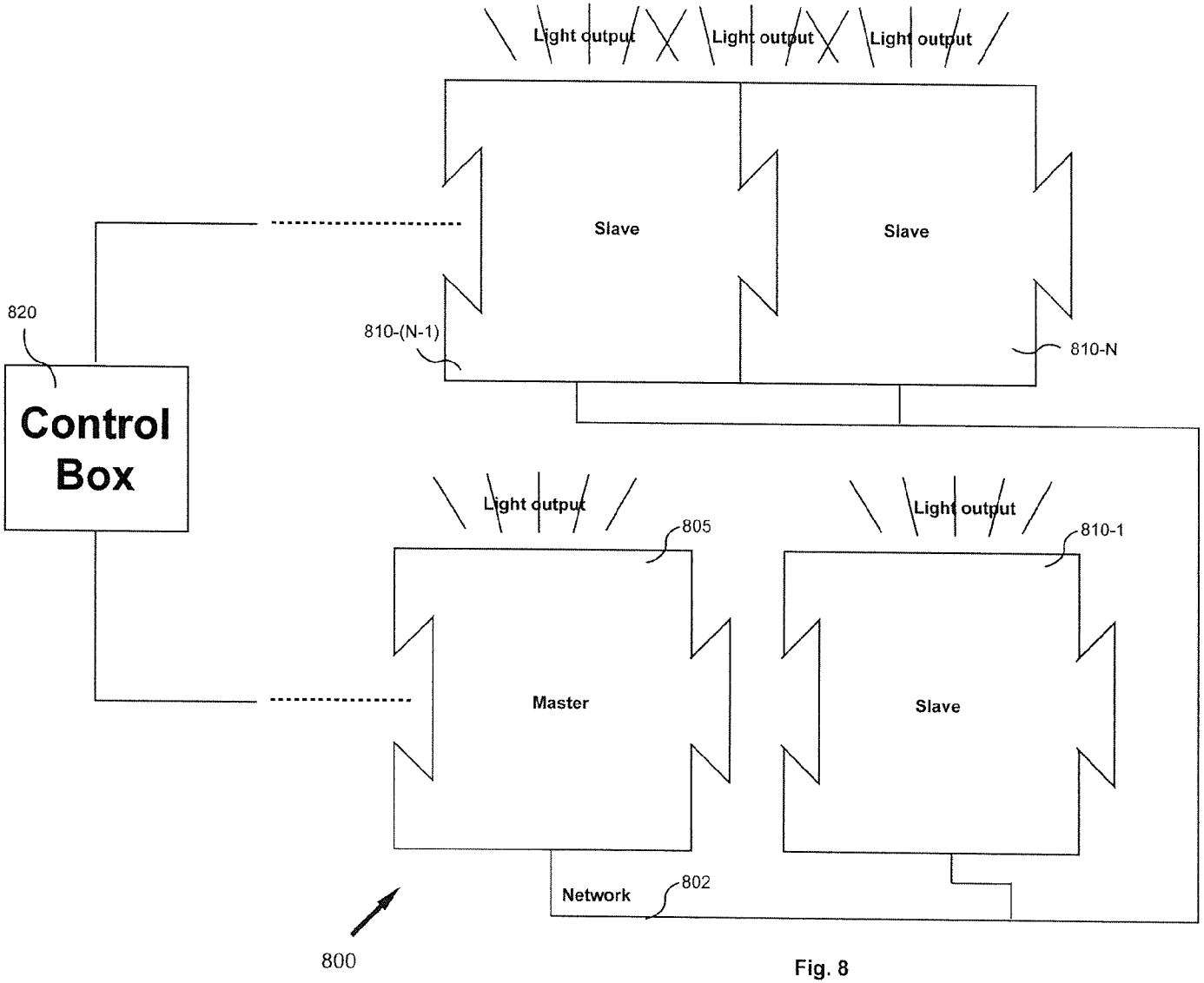
FIG. 8 shows an embodiment of an apparatus having a number of modular lighting array units interlocked with diamond-like mating connections and in communication via a network.

FIG. 8 shows an embodiment of an apparatus 800 having a number of modular lighting array units 810-1 . . . 810-N, and 805 interlocked with diamond-like mating connections and in communication via a network 802. Modular lighting array units 810-1, . . . 810-N and 805 are shown as communicatively interconnected, however, modular lighting array units 810-(N−1) and 810-N are not typically arranged in the light path of modular lighting array units 810-1 and 805. With modular lighting array units 810-1, . . . 810-N and 805 interconnected with communication lines to form a communication network, modular lighting array unit 805 may be selected as a master unit to control the lighting functions of itself and the other modular lighting array units 810-1, . . . 810-N. Controlled functions may include, but are not limited to, on-off control, dimming, timing, and status functions. Each modular lighting unit may be controlled by master 805 to output the same intensity of light. In an embodiment, master 805 may set different light output levels for one or more of the modular lighting array units 810-1, . . . 810-N and 805 of apparatus 800. In one embodiment, the dimming function may be accomplished via a user interface which reads out light attenuation as f-stops.

In an embodiment, where all the modular lighting array units of apparatus 800 may be identical, any modular lighting array unit may be selected as the master unit. Selection of a particular modular lighting array unit as master may be performed when the modular lighting array units may be interlocked together or may operate apart. In an embodiment, all the modular lighting array units of apparatus 800 may not be identical but may contain a number of common components such that any modular lighting array unit may be selected as the master unit. A controlling light "master" may be switched into a controlled "slave" and vice versa. The controller of the selected master unit may control the other modular lighting array units and verify the intensity level of the other modular lighting array units, banks or clusters through communication with the other modular lighting array units, banks or clusters via network 802.

Network 802 may be a network in which each of modular lighting array units 810-1 . . . 810-N and 805 may transmit and receive data. In an embodiment, master unit 805 sends a specified control signal or command to one or more of the modular lighting array units 810-1 . . . 810-N. Upon receiving a control signal or command, modular lighting array unit 810-*i* may respond with a verification code that it received the control signal or command. Modular lighting array unit 810-*i* may implement the function corresponding to the received the control signal or command. The verification code may be an acknowledgment of reception, that is, an indicator that a control signal or command was received. The verification code may be correlated to reflect that one of a number of possible control signals or commands was received and that the verification code confirms that the receiving modular lighting array unit 810-*i* has or will implement the desired function. In an embodiment, master unit 805 has a set of commands, each command being a different control signal or command, where each control signal or command has its own unique code and corresponding unique verification code. The command may be sent to and responded by all the modular lighting array units 810-1 . . . 810-N. The command may be sent to and responded by one or a fraction of all the modular lighting array units 810-1 . . . 810-N.

In one embodiment, a master unit 805 may transmit one or more packets to each of the modular lighting array units 810-1 . . . 810-N on the network 802. One of the packets transmitted may be an address and another packet may be an intensity measurement. In such a unidirectional protocol, the master unit 805 may be able to control each of the modular lighting array units 810-1 . . . 810-N on the network 802. For example, and without limiting the invention, if the master unit 805 wanted to adjust a modular lighting array unit 810-6 to 47% intensity, the master unit 805 may transmit the following two packets to each of the modular lighting array units: "A6<return>V47<return>." In another example, if the master unit 805 wanted to adjust all of the modular lighting array units 810-1 . . . 810-N to a certain intensity value, it may transmit a command with only an intensity value and omit the address parameter. It can be appreciated that a wide variety of commands and packets may be sent, and are not just limited to adjusting the intensity value.

In an embodiment, the communication on network 802 may include transfer of data between the modular lighting array units and the selected master unit. The data may include raw data regarding the operational parameters of the individual modular lighting array unit, such as the current, voltage or temperature to the ALS within the individual modular lighting array unit, which can be correlated back to an intensity level by the master unit. Alternatively, each individual modular lighting array unit may process its own operating parameters and transfer information back, such as the intensity level of the light from the individual modular lighting array unit. The raw data and/or processed information are not limited to intensity of the light output from an individual modular lighting array unit. The raw data and/or processed information may include, but are not limited to, temperature information and status of each lighting source in the ALS of the individual modular lighting array unit. A protocol may be established to handle the communication.

Network 802 may be operated as a local area network (LAN). Communication on network 802 may be handled using a propriety format, that is, one established for a given network, or communication on network 802 may be handled using one of a variety of communication standards. The communication medium for network 802 may be a wired medium such as stranded wire pairs or a cable medium, or alternatively, may be an optical fiber. Network 802 may be a wireless network. Communication on wireless network 802 may be handled using a propriety format or using one of a variety of wireless communication standards. Network 802 may be a power line communications network using the power lines of apparatus 800. In several embodiments, network 802 may operate based on light-based communications of radiation along different points of the light spectrum. For example, the network 802 may operate based on infrared (IR), laser-linking, or in a connected fashion such as fiber optics; magnetic coupled communications such as electromagnetic induction coupling; sonic communications including ultrasonic; and RF communications such as Bluetooth. The network operations and communications options may vary based on the location of the apparatus. For example, for an apparatus that must facilitate underwater communications, power-line communications would not be suitable, whereas electromagnetic induction coupling may be better, or IR may be advantageous for short-range communications and ultrasonic means would be suitable for long range communications. Further, the network operations and communications may vary to account for extreme temperatures or humidity, various biomes, or other harsh environments.

Figure 9:
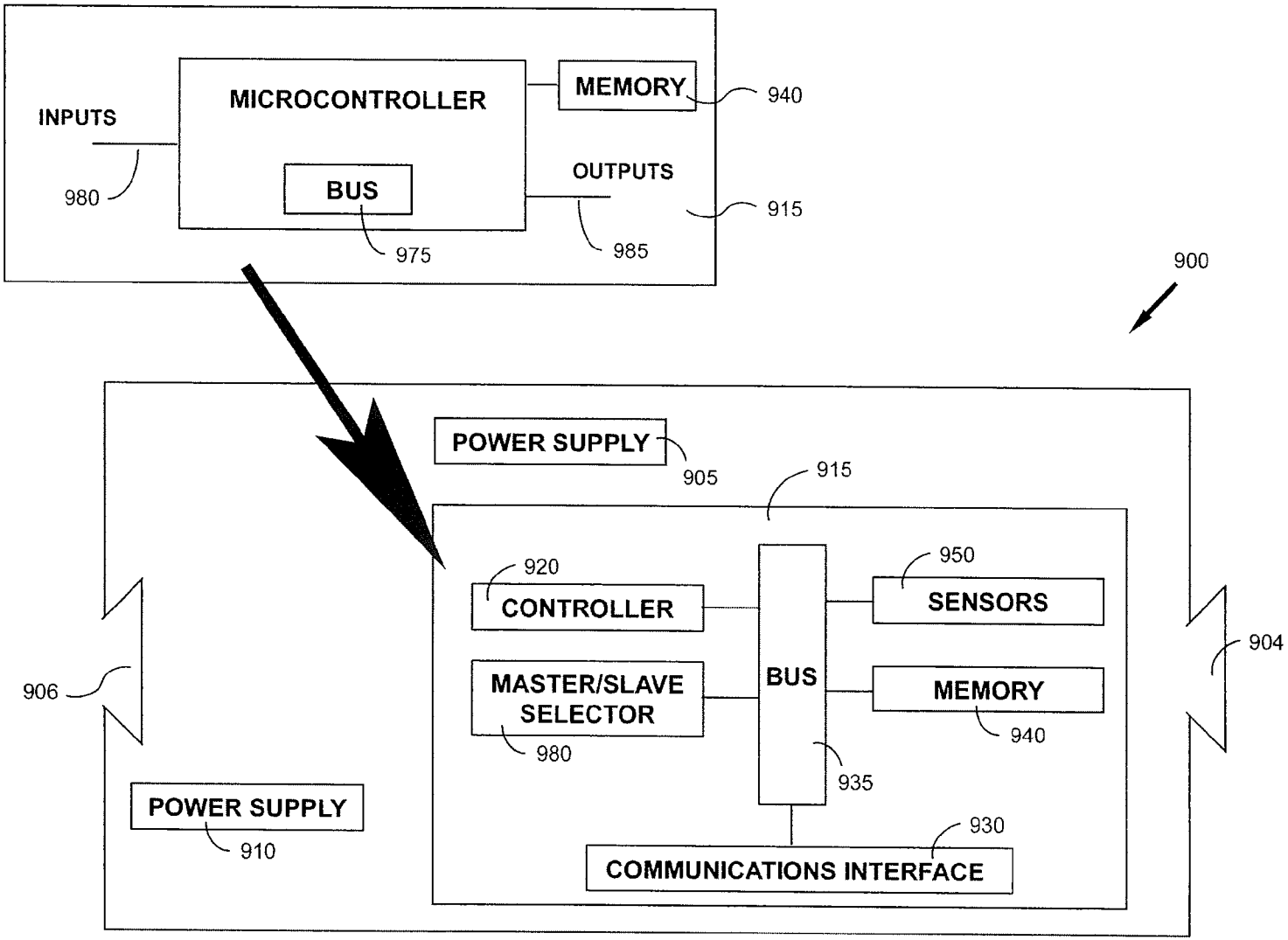
FIG. 9 illustrates a block diagram of an embodiment of an individual modular lighting array unit that may be interlocked with other individual modular lighting array units and networked.

FIG. 9 illustrates a block diagram of an embodiment of an individual modular lighting array unit 900 that may be interlocked with other individual modular lighting arrays to form a bank or cluster and networked. Individual modular lighting array unit 900 includes ALS 905, interlocking mechanisms 904, 906, power supply 910, and electronics 915. ALS 905 may be realized as an array of LEDs. ALS 905 may be configured with one or more light sources. Interlocking mechanisms 904, 906 may be diamond-like mating connections, spherical mating connections, a bolting mechanism, or combinations thereof. It should be understood that a group of modular lighting array units may be sealed and protected from exposure to surroundings, such as using a water-proof seal or a hermetic seal, or otherwise insulated from its surroundings.

In another embodiment of the invention, zener diodes may be employed across each individual LED. In one embodiment, where the ALS of LEDs is series-connected, in the event that an individual LED fails in the open state, the entire ALS would not extinguish the zeners in place. In another embodiment, the power supply may regulate the current to the ALS such that the LEDs may not strobe or flicker. In such an embodiment, the power supply would not control the intensity of the ALS by pulse width modulation (PWM). By reducing or eliminating strobing or flickering effects, the invention is beneficial when used in film and video production, because there is no interaction between the light and the camera shutter, which may otherwise occur with some HMI and fluorescent ballasts, in other words, visible beat frequencies showing up as strobing.

Electronics 915 may include a controller 920 having control circuitry to manage other individual modular lighting array units to which it is interlocked and coupled by a network via a communications interface 930. Controller 920 may be a processor that executes instructions to control other individual modular lighting array units using instructions stored on machine-readable medium, such as but not limited to, memory 940. The machine-readable medium may be any computer-readable medium. Controller 920 or processor 920 may be coupled to memory 940 and communications interface 930 by a bus 935. Bus 935 may be a parallel bus. Bus 935 may be a serial bus. Other peripheral devices may be coupled to bus 935. Alternatively, each component of electronics 915 and/or individual lighting array unit 900 may be individually communicatively coupled to other components of electronics 915 and/or individual lighting array unit 900.

Electronics 915 may include sensors 950 or connections to sensors 950 attached or embedded in individual lighting array unit 900. Such sensors may include, but are not limited to, temperature sensors such as thermocouples. Controller 920 or processor 920 may monitor the output of sensors 950 to ascertain the status of individual lighting array unit 900 such that controller 920 or processor 920 may signal or alarm a faulty condition and/or shut down individual lighting array unit 900 if necessary.

In another embodiment, electronics 915 may include a microcontroller chip 970 that includes an internal bus 975. The microcontroller chip 970 may have as inputs 980 several switches for controlling the operating mode and setting parameters of the lighting array unit 900 including the master unit, slave units, or other modular lighting array units, network, intensity, addresses, etc. The microcontroller chip 970 may also have inputs 980 which include an input communications jack and sensors, which may be temperature sensors that connect directly to the microcontroller chip 970. The microcontroller chip outputs 985 may include an LCD display, commands to the power supply for intensity adjustment, and an output communications jack. In one embodiment, there may be a block of non-volatile memory connected to the microcontroller chip 970 which can be used for data logging. For example, the memory may be used for monitoring the temperature and usage profile of the ALS 905.

Individual lighting array unit 900 may be set as a slave unit or a master unit when it is interlocked and networked with other lighting array units to form a bank or cluster. Master/slave selector 960 may be realized in a number of configurations. Master/slave selector 960 may include a toggle switch to select master or slave. In an embodiment, when selected as a slave unit, the slave unit may provide talk back signals onto the network in response to receiving a control signal. If a slave unit receives a control signal from two different units that have been set to master by their respective master/slave selectors, the slave unit may set its function to a value between the values corresponding to the two command signals. For example, if a slave unit receives a command signal for 100% lighting intensity from one master unit and 20% lighting intensity from another master unit, the slave unit can set its intensity to 60% lighting intensity. In an embodiment in which there is only one master unit in a network of individual lighting array units, use of a toggle switch may be accompanied by a procedure to determine the master unit. With master/slave selector 960 coupled to bus 935, in responsive to toggling to master, a signal may be sent via communications interface 930 that a master was set, where any master unit in the network receiving the signal toggles itself to slave.

An electromechanical, mechanical, or software switch that is also receptive to a control signal, in addition to manual setting, may be used as the master/slave selector 960 for self toggling. In such an arrangement, the last individual lighting array unit that toggles to master becomes the master unit in the network of individual lighting array units. Other protocols may be implemented to select the master unit in a network of individual lighting array units. In another embodiment, an individual lighting array unit 900 may have an electromechanical, mechanical, or software switch that is also receptive to a control signal, which toggles between three positions: master, slave, and addressable. The difference between the slave and addressable modes is that a specific address may be assigned in the addressable mode.

In another embodiment, the network 802 may be configured automatically through detection of the status of the banks or clusters of connected modular lighting array units. For example, in a series of wire-connected modular lighting array units, the first unit in the chain may detect that there is nothing connected to its input jack, and may set itself as the master unit. The next and subsequent modular lighting array units in the series may detect other units in their input jacks, so they may set themselves as slave units. In another embodiment, if the series of units detected a Hand Dimmer or DMX Converted Box 820 connected, they may set themselves to addressable units and display their unique addresses on their LCD screens. Further, the series of units may communicate to establish unique addresses so that those unique addresses may be displayed.

In another embodiment, the communications interface 930 may include a positional-detection feature for the modular lighting array units such that the last modular lighting array unit in a series of connected units may determine that it is the last unit in the chain. For example, each individual unit may detect whether there are any units ahead of it or behind it in a chain of units. If there are units ahead of it, then the individual unit may set itself to an addressable or slave mode. If there are units behind it in the chain, then it can pass the signals that it receives through to the units behind it in the chain. If there are no units behind it in the chain, then the individual unit may switch to a terminating resistor on the last ALS.

Master/slave selector 960 may realized as a data master interface 960 that is an interface to communicate externally such that an individual lighting array unit 900 may be set to master unit or slave unit via this data master interface by an external electronic device or system. Data master interface 960 may be realized as a serial data input, a parallel data input, an optical input, or a wireless input. Data master interface 960 may be realized as a standard communication port. Data master interface 960 allows the individual lighting array units in the lighting network to be set to a desired master-slave arrangement in effectively the same time period. In an embodiment, master/slave selector 960 may include a master/slave toggle and a data master interface. In an embodiment, master/slave selector 960 may include a master position, a slave position, and a data master interface.

Figure 10:
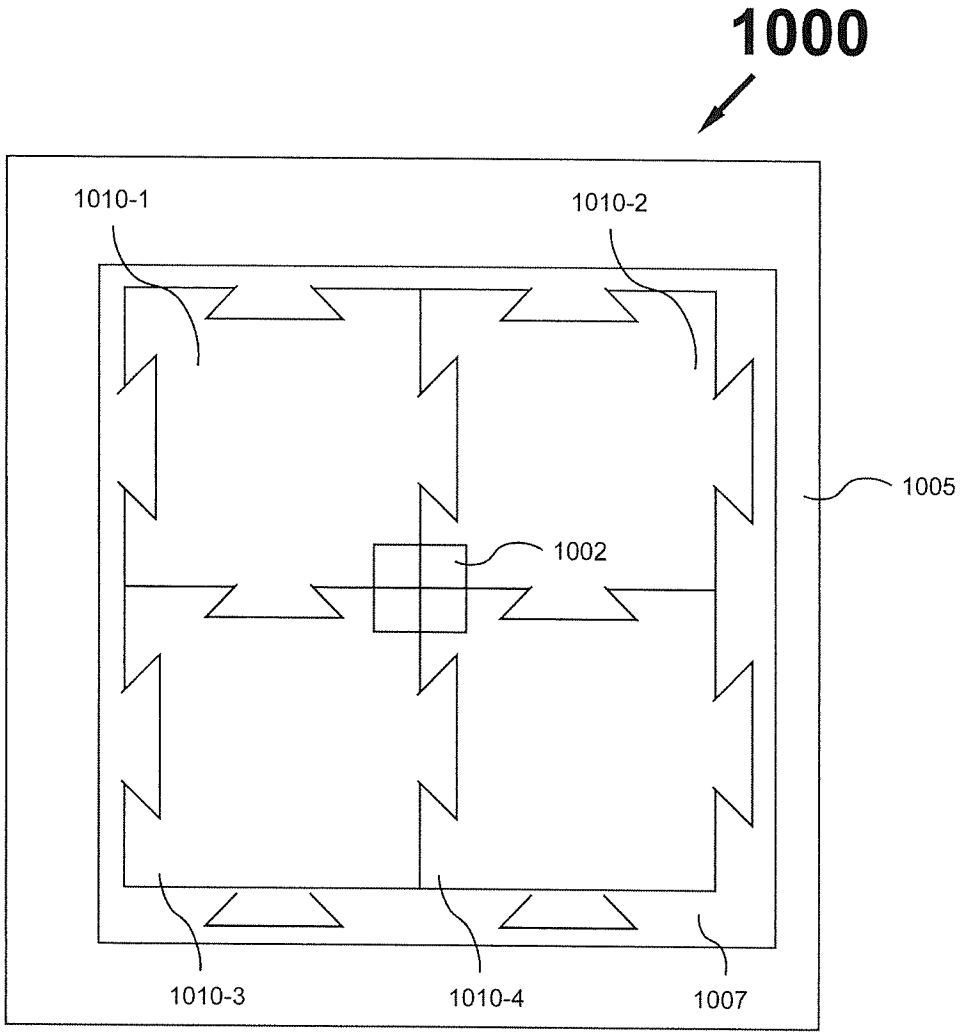
FIG. 10 illustrates an embodiment of a system having a number of individual modular lighting array units interlocked and networked according to various embodiments similar to those discussed herein.

FIG. 10 illustrates an embodiment of a system 1000 having a number of individual modular lighting array units interlocked and networked according to various embodiments similar to those discussed herein. System 1000 includes a housing 1005 in which networked modular lighting array units 1010-1 . . . 1010-4 are disposed on a heat sink 1007 and communicatively coupled by network 1002. System 1000 is not limited to four modular lighting array units but may have more or less modular lighting array units depending on the application. Modular lighting array units 1010-1 . . . 1010-4 may be coupled by an embodiment of an interlocking mechanism according to the teachings discussed herein. Each of modular lighting array units 1010-1 . . . 1010-4 may be configured and operative in a manner as discussed with respect to FIGS. 8 and 9 or various other embodiments for a modular lighting array units. Heat sink 1007 may be realized as a single heat sink or a combination of heat sinks. It can be appreciated that the scope of the invention will not be limited to any particular construction of a heat sink, but will include any cooling device which transfers the heat generated by the LEDs. Thus, in some embodiments of the invention, a solid state fan with no moving parts, which cools using air flow which moves due to magnetic forces, may operate as a heat sink within the scope of the invention.

Figure 11:
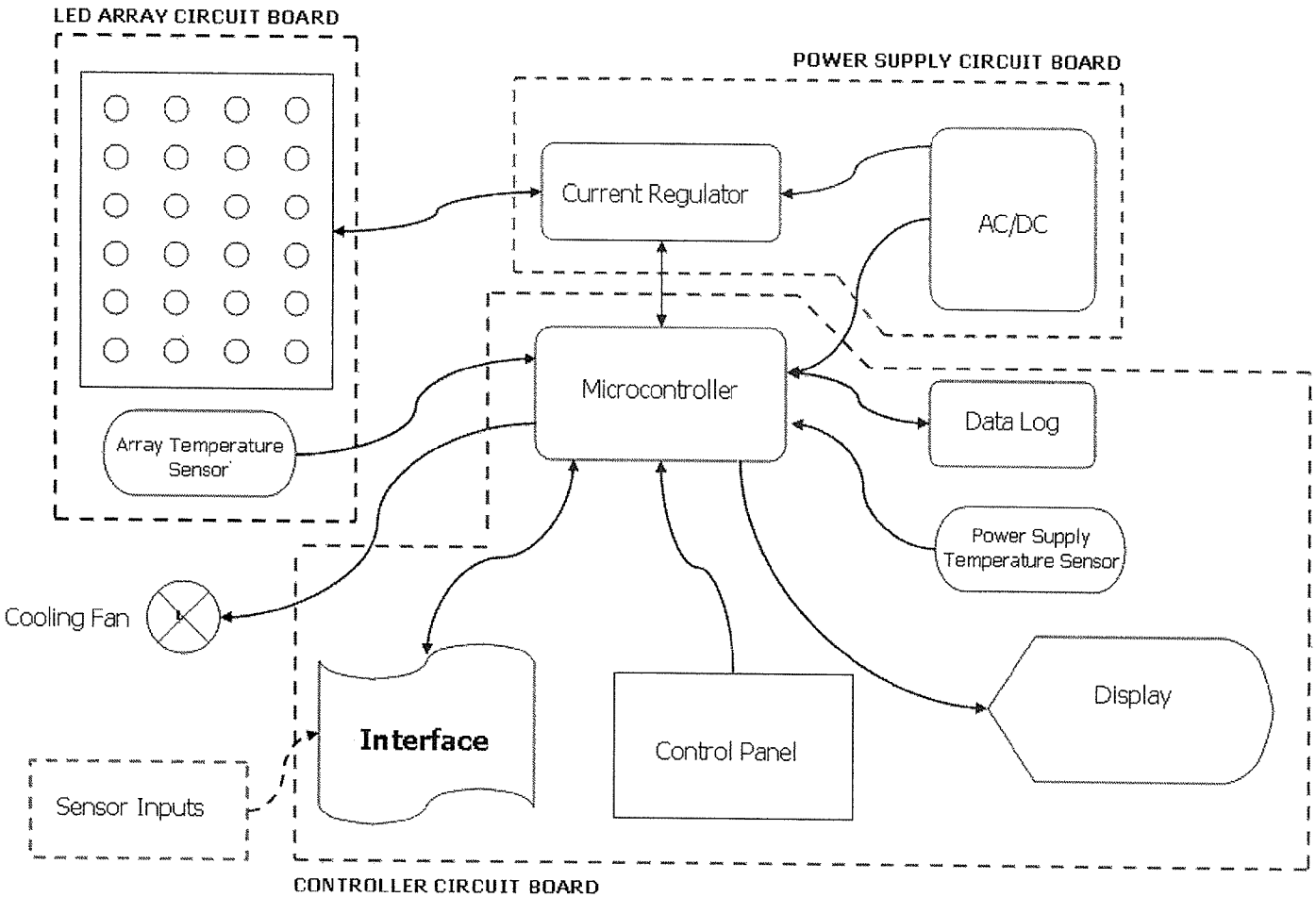
FIG. 11 illustrates a diagram of an embodiment of a system having a controller circuit board, power supply circuit board, and LED array circuit board.

FIG. 11 illustrates a diagram of an embodiment of a system having a controller circuit board, power supply circuit board, and LED array circuit board. Referring to FIG. 11, the controller circuit board may include a control panel, a microcontroller, and a power supply temperature sensor. The circuit board may have an interface which receives inputs from motion sensors, proximity sensors, timers or clocks, ambient light sensors, etc. The controller circuit board may also have an LC Display, and in addition may also include a data log, with which the microcontroller may utilize to store data. The microcontroller may also receive input from a temperature sensor on the LED array circuit board, which may reflect the temperature of the LED modular lighting array unit(s). The microcontroller may also communicate with a current regulator, which may control the current which is being sent to the LED array circuit board. Further, the microcontroller may receive inputs from the power supply temperature sensor, or power supply unit, control panel, or other sensors via the interface, to regulate the current which is being fed to the LED array circuit board. In addition to regulating the current supplied to the LED array circuit board, the microcontroller may also regulate operation of the system's cooling fan, what is displayed on the LC Display, the data being logged in the data log. The current regulator from the power supply circuit board may receive input from the microcontroller, as well as the high voltage supply from the power supply, and regulate the current supplied to the LED array circuit board. The current regulating LED power supply may also include a cooling fan which is run at partial speed to reduce noise emitted from the cooling system. In addition, the LED power supply may have a temperature sensor to increase the speed of the cooling fan as necessary to prevent damage to the LEDs or power supply.

Several benefits of the invention disclosed herein include reductions in emitted UV (protection for the eyes and skin), reductions in heat emissions (reducing air conditioning costs and saving on expendables such as filter gels), RoHS compliancy (no lead/mercury used in the product), and maximizing recycleability/reuse of the components of the lighting instruments for environmental sustainability).

Although specific embodiments have been illustrated and described herein, it will be appreciated by those of ordinary skill in the art that any arrangement that is calculated to achieve the same purpose may be substituted for the specific embodiments shown. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description.

What is claimed is:

1. A system for networking modular lighting array units comprising:

a plurality of modular lighting array units interconnected, each modular lighting array unit having a two-dimensional array of light sources, wherein each light source throughout the plurality of interconnected modular lighting array units is equally spaced apart from all neighboring light sources in each of the two array dimensions;

a network to communicatively couple the modular lighting array units; and a master lighting array unit for controlling lighting functions of the master lighting array unit and other slave modular lighting array units.

2. The system of claim 1, wherein any of the modular lighting array units is selectable as the master lighting array unit.

3. The system of claim 1, wherein the master lighting array unit controls on-off control, dimming, timing, intensity or status functions.

4. The system of claim 1, wherein the slave modular lighting array units may communicate responses over the network.

5. The system of claim 1, wherein the network is a local area network, a wireless network, or a power line communications network.

6. The system of claim 1, wherein the network communicates using stranded wire pairs, a cable medium, an optical fiber, a power line, infrared, laser-linking, electromagnetic induction coupling, sonic communications, ultrasonic communications, or RF communications.

7. The system of claim 1, wherein the master lighting array unit controls the lighting functions to operate as a flash or strobe.

8. A method for controlling a plurality of interconnected modular lighting array units connected on a network, each modular lighting array unit having a two-dimensional array of light sources, wherein each light source throughout the plurality of interconnected modular lighting array units is equally spaced apart from all neighboring light sources in each of the two array dimensions, the method comprising the steps of:

selecting a master unit to control lighting functions of the master unit and the plurality of modular lighting array units;

sending a control signal corresponding to a lighting function from the master unit to at least one of the plurality of modular lighting array units;

receiving a control signal corresponding to a lighting function from the master unit; and implementing the lighting function.

9. The method of claim 8, wherein any of the modular lighting array units is selectable as the master unit.

10. The method of claim 8, wherein the lighting function is on-off control, dimming, flashing, strobing, or timing of an individual modular lighting array unit.

11. The method of claim 8, further comprising the step of sending a verification code from at least one of the plurality of modular lighting array units to the master unit or control box.

12. The method of claim 8, wherein the network communicates using stranded wire pairs, a cable medium, an optical fiber, a power line, infrared, laser-linking, electromagnetic induction coupling, sonic communications, ultrasonic communications, or RF communications.

13. An interchangeable lens module comprising:

a plurality of lighting units interconnected for reconfiguring size and output of a lighting array, each lighting unit having a two-dimensional array of light sources, wherein each light source throughout the plurality of interconnected lighting units is equally spaced apart from all neighboring light sources in each of the two array dimensions;

wherein each lighting unit includes an interchangeable lens; and a carrier plate for adjusting a beam dispersion resulting from the plurality of lighting units.

14. An interchangeable lens module as in claim 13, wherein the light source includes one or more light emitting diodes.

* * * * *